US006425779B1

(12) United States Patent
O'Brien, II

(10) Patent No.: US 6,425,779 B1
(45) Date of Patent: Jul. 30, 2002

(54) FLEXIBLE TAPE CONDUCTOR

(75) Inventor: James A O'Brien, II, LaSalle, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/794,172

(22) Filed: Feb. 27, 2001

(51) Int. Cl.[7] ..... H01R 11/20
(52) U.S. Cl. ..... 439/422; 439/162
(58) Field of Search ..... 439/422, 425, 439/492, 494, 499, 162

(56) References Cited

U.S. PATENT DOCUMENTS 3,007,131 A * 10/1961 Dahlgren et al. ..... 439/492
3,027,417 A * 3/1962 Turner, Jr. ..... 174/169
5,059,134 A 10/1991 Schauer et al. ..... 439/164
5,061,195 A 10/1991 Bolen ..... 439/164
5,230,713 A 7/1993 Schauer ..... 29/856
5,460,535 A 10/1995 Bolen ..... 439/164
5,667,401 A * 9/1997 Kuwabara et al. ..... 439/405
5,685,728 A 11/1997 Okuhara et al. ..... 439/164
5,860,831 A * 1/1999 Roder et al. ..... 439/422

* cited by examiner

*Primary Examiner*—Brian Sircus
*Assistant Examiner*—Michael C. Zarroli
(74) *Attorney, Agent, or Firm*—Jennifer Stec

(57) ABSTRACT

An electrical termination arrangement 70 including a multiple lead conductive flexible tape 14 has first and second ends, the first end being operatively associated with a first member. A stamped terminal has pins 73 corresponding to multiple leads 17 of the tape 14. The pins have first ends 80 for connection with a second member non-positionally affixed with respect to the first member. The pins 73 are parallel spaced from one another and are serially increasing in length. The pins 73 have contact areas 97 with the conductive flexible tape leads 17 in a serially laterally increasing manner.

5 Claims, 3 Drawing Sheets

FLEXIBLE TAPE CONDUCTOR

FIELD OF THE INVENTION

The field of the present invention is that of electrical connector termination arrangements utilized with flexible conductors. More particularly, the field of the present invention is that of clock spring interconnectors and electrical connector terminations utilized therein.

BACKGROUND OF THE INVENTION

An increasing number of automotive vehicles have inflatable supplemental occupant restraint systems (commonly referred to as air bag assemblies.) An air bag assembly for the driver is typically located on the steering wheel facing the driver. The air bag assembly must be in continuous electrical connection with acceleration sensors in the car body (this connection is typically through a restraint control module). In a frontal crash the sensors provide a control electrical signal to an air bag inflator which instantly inflates an air bag envelope in the event of a predetermined vehicular deacceleration.

There is a need for an electrical interconnection between a rotatable portion of the air bag assembly which is mounted on the steering wheel, and a remaining portion of the air bag assembly and/or wiring which is mounted in a stationary position inside the steering column. Electrical interconnectors between rotatable and stationary parts are well known. Typically, a rotatable electrical interconnector includes an electrical brush which rests upon a conductive ring. However, there is a perceived slight risk, particularly during the impact of an accident, of a transient interruption of electrical connection with a brush and ring system, which could possibly result in a malfunction of the air bag assembly. Accordingly, Federal Motor Vehicle Safety Standards (FMVSS) have been promulgated requiring continuous-type electrical interconnectors.

One example of a continuous-type electrical interconnector is a clock spring interconnector which includes an outer housing and a rotor hub. The housing and rotor hub rotatably are associated with one another at a plurality of bearing surfaces. An elongated "clock spring" is located inside the interconnector. The clock spring is formed from a plurality of electrical leads referred to as conductors which are encased by polymeric tape such as Mylar®. The clock spring is conductively attached at both ends to conductor terminal pins that pass out of the interconnector to unite the air bag assembly to the aforementioned sensors. The clock spring interconnector is mounted on the steering column, allowing a steering wheel to be rotated in either direction while a continuous, positive electrical connection is provided between air bag assembly and sensors via the clock spring interconnector.

Recently, more advanced passenger restraint systems have been brought forth. An advanced passenger restraint system includs several sensors that are used to classify and/or locate the front seat occupants. The classification and location data is in turn used to optimize the restraint system to a particular combination of occupants and their positions in crash scenarios. For example, a smaller occupant seated close to the steering wheel may not warrant an air bag deployment in some crash events while a larger occupant seated well away from the steering wheel or far back in the passenger seat may receive a maximum power air bag deployment. Other combinations of occupant class and position may receive a partial air bag deployment. The advanced restraint system accordingly requires more electrical conductor lines between a restraint control module and the air bag assembly in the steering wheel. Additionally, in premium vehicles, it is often desirable to have other various vehicle control functions actuated by control buttons placed on the steering column such as the heating, ventilating and air conditioning system of the vehicle and also the turn signals, cruise control and the sound system for the vehicle. It may be desirable to have these other various controls be electrically interconnected through the clock spring.

Regardless of the above-noted desires, there is a physical limitation upon the width of the clock spring. The amount of space that the clock spring occupies is limited due to space considerations in the interior of the vehicle. To allow for the different electrical functions to be facilitated by the clock spring, the spacing or pitch between the conductor lead lines is minimized. The conductor leads of the clock spring are contained between two layers of dielectric material. To attach the conductors of the dielectric material to terminal pins which are fixed with respect to the steering wheel or steering column, a stamped terminal design is utilized. The terminal pins are stamped in a generally L-shaped manner to achieve terminals with the least amount of mass as possible. The terminal pins are stamped from a flat sheet metal of conductive foil. The terminal pins, in a simultaneous operation, are connected to their various conductor leads of the conductive tape and thereafter are slit to separate them to achieve independent electrically conductive paths.

The conductors of the clock spring tape may be thin wires or may be a powdered metal which is positioned by the dielectric tape material. Accordingly, the pitch achievable on the clock spring tape is very small and is not a limiting function in clock spring interconnector design. In contrast, the terminal pins as previously mentioned, are stamped from a common sheet of foil conductive material. Due to the limitations of present commercially viable stamping technology, the pitch or spacing between the pin terminals from center to center at a minimum should be approximately 1.5 times the thickness of the foil material plus ½ the width of the pin. Therefore, if the pitch of the leads of the clock spring is too small there is no present way of economically providing for their electrical connection to a stamped pin terminal. Accordingly, for a clock spring interconnector with an ever increasing amount of electrical leads, a width (height) of the clock spring interconnector becomes excessive and makes it non-feasible for use between the steering wheel and steering column.

It is desirable to provide an electrical termination arrangement between a multiple lead conductive flexible tape which is operatively associated with a first member and a stamped terminal having pins corresponding to the multiple leads of the tape wherein the pins are connected with a second member which is non-positionally affixed with respect to the first member and wherein the height of the flexible tape can be minimized.

SUMMARY OF THE INVENTION

To make manifest the above delineated and other desires a revelation of the present invention is brought forth. A preferred embodiment of the present invention provides a termination arrangement which is particularly useful in clock spring electrical interconnectors. The termination arrangement of the present invention includes a multiple lead conductive flexible tape having first and second ends. The first end of the tape is operatively associated with a first member. A stamped terminal is provided. The terminal has pins corresponding to the multiple leads of the tape. The terminal pins have a first end for connection with a second member which is non-positionally affixed with respect to the first member. The pins of the terminal are parallel spaced from one another with a pin-to-pin center distance of approximately 1.5 times a thickness of a sheet of material the terminal pins are stamped from plus ½ the width of the terminal pins. The terminal pins serially increase in length. The terminal pins contact the leads of the tape in a serially lateral increasing manner. Accordingly, the spacing between the leads of the tape is generally substantially less than the spacing between the terminal pins. Accordingly, the width of the flexible tape can be minimized without regard to whether or not a stamped pin terminal can be provided which matches the pitch of a flexible tape which has its width held to a minimum value.

It is an advantage of the present invention to provide an electrical termination arrangement of a flexible tape conductor to a stamp pin terminal. It is another advantage of the present invention to provide an electrical termination arrangement as described in a clock spring electrical interconnector. Other advantages of the invention will become more apparent to those skilled in the art from a reading of the following detailed description and upon reference to the drawings.

DETAILED DESCRIPTION OF THE INVENTION

Figure 1:
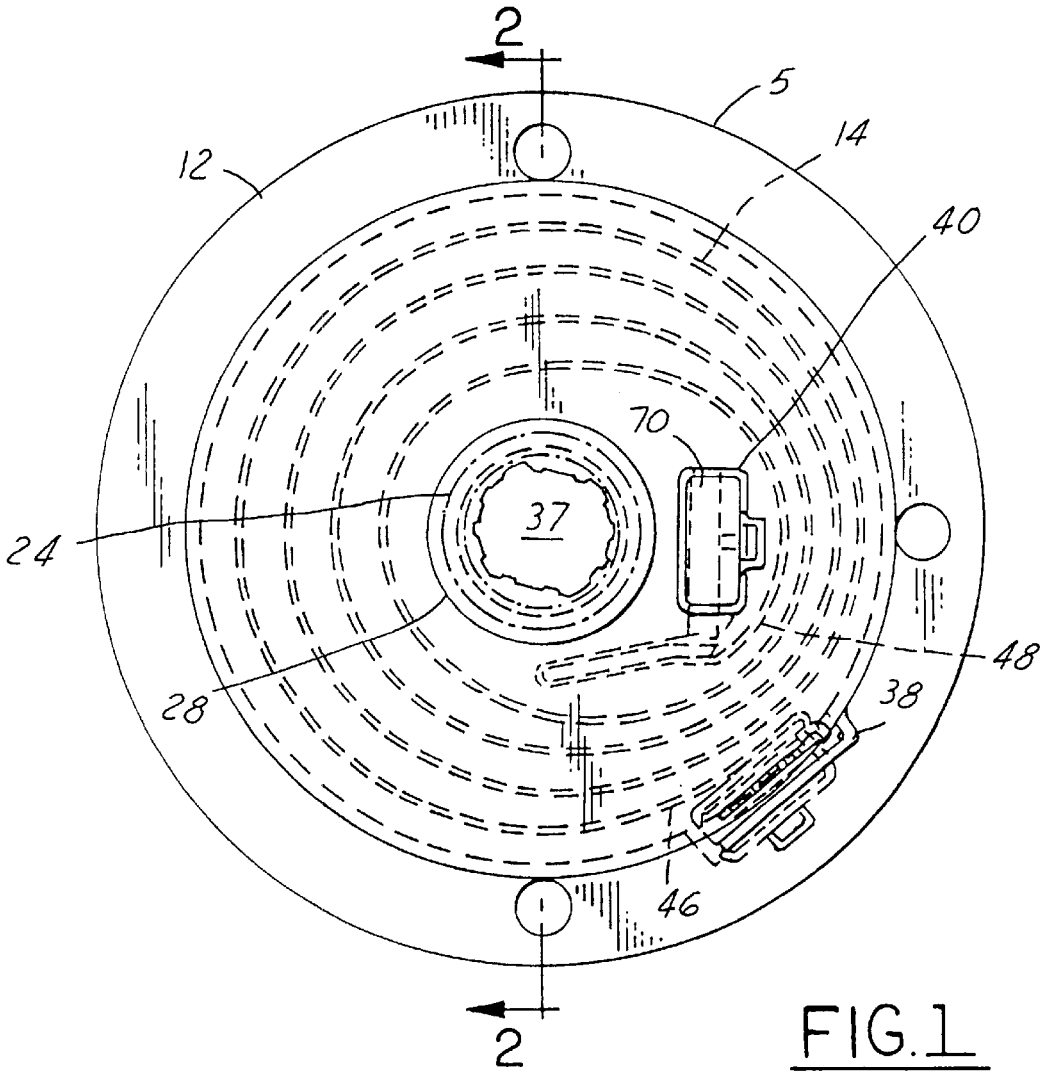
FIG. 1 is a top view of a clock spring assembly utilizing an electrical termination arrangement of the present invention.
Figure 2:
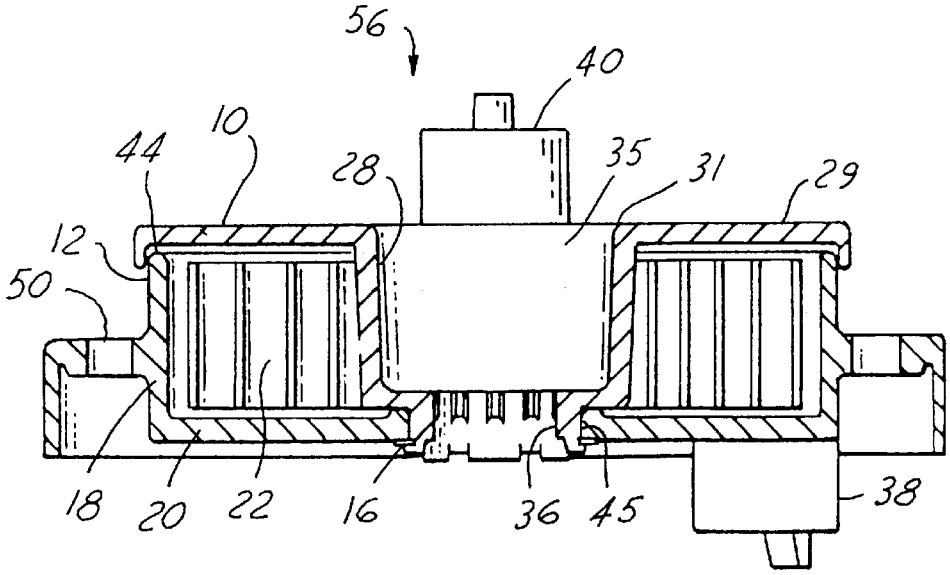
FIG. 2 is a side sectional view of a clock spring assembly shown in FIG. 1.
Figure 3:
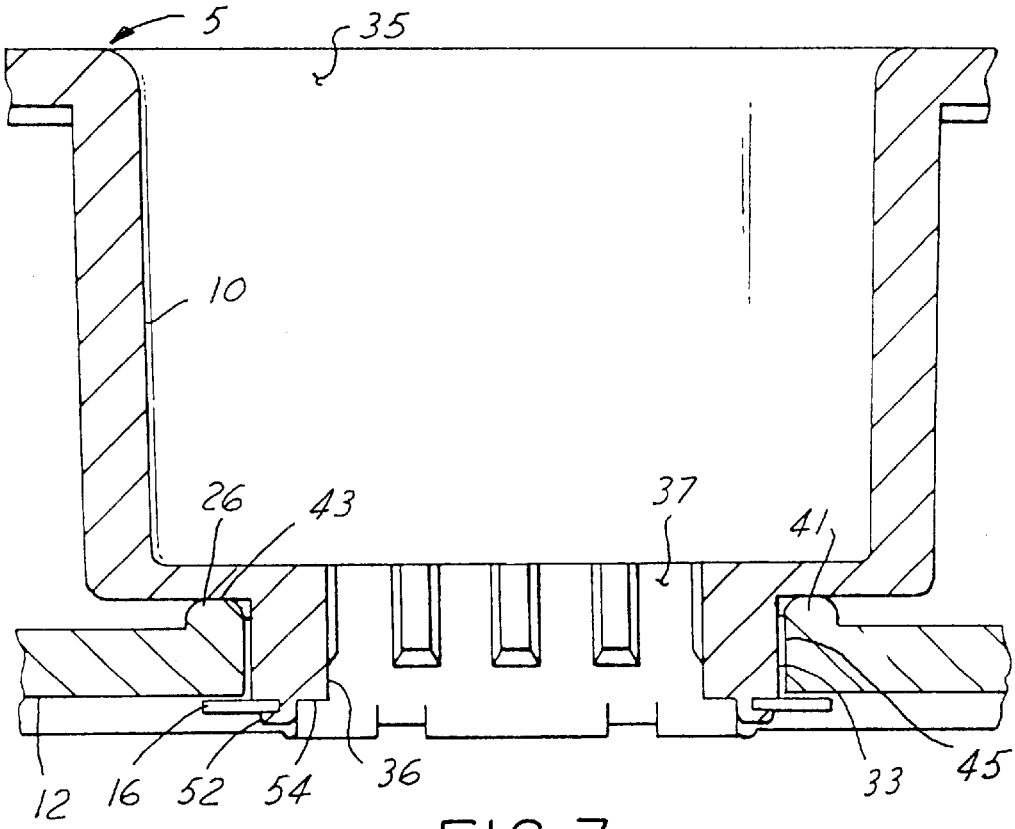
FIG. 3 is an enlarged partial sectional view of a bearing portion of the clock spring assembly shown in FIG. 2.

FIGS. 1–3 show a typical clock spring assembly 5 which utilizes a terminal arrangement 70 of the present invention. The clock spring assembly 5 includes a hub 10 and a housing 12. The housing 12 includes a first radial wall 18 perpendicularly attached to a base 20. The first radial wall 18 has a housing lip 44 which is located on the dimension of the first radial wall 18 opposite that of its perpendicular attachment to the base 20.

The base 20 and the first radial wall 18 combine to define the housing 12 having a circular depression 22 with a circular first aperture 24 located in the base 20 of the housing 12. The first aperture 24 includes an aperture lip 26 (FIG. 3). The housing 12 also includes fastener mounts 50. The housing 12 is fixed via fastener mounts 50 with the steering column (not shown). The hub 10 is fixed with a steering wheel or shaft (not shown) and in a well known manner rotates with respect to the steering column.

The hub 10 of the clock spring assembly 5 includes a second radial wall 28, and an annular ring 29 (FIG. 2). The second radial wall 28 is perpendicularly attached to the inside dimension 31 of the annular ring 29. The second radial wall 28 in combination with the annular ring 29 defines a second circular depression 35 which includes a walled second aperture 37 (FIG. 1). The walled second aperture 37 has a circular outer dimension 33 with a radius smaller than that of the circular first aperture 24. The walled second aperture 37 also has an inner dimension 36.

The hub 10 of the clock spring assembly 5 is rotatably associated with the housing 12 by means of a single radial bearing 41 (FIG. 3). The radial bearing 41 has a first bearing surface 43 perpendicularly associated with a second bearing surface 45. Both bearing surfaces are radial in dimension and located at the points where the aperture lip 26 of the circular first aperture 24 contacts the circular outer dimension 33 of the walled second aperture 37.

The hub 10 and the housing 12 are united using a retaining ring 16 having an inner radius smaller than the circular outer dimension 33 of the walled second aperture 37. The retaining ring 16 also has an outer radius slightly larger than the radius of the first aperture 24. The retaining ring 16 is frictionally held into place by a plurality of stakes 52 which are perpendicularly attached to a bottom 54 of the hub 10.

Figure 6:
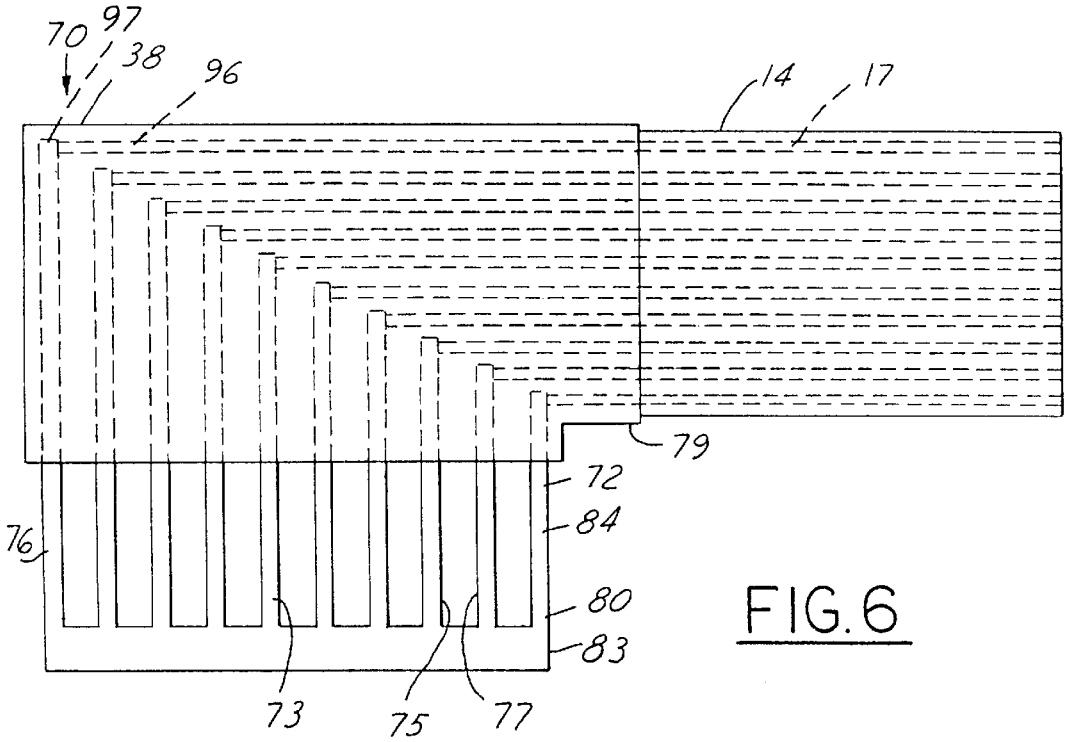
FIG. 6 is a view similar to FIG. 4, of a terminal arrangement of the present invention during fabrication.
Figure 7:
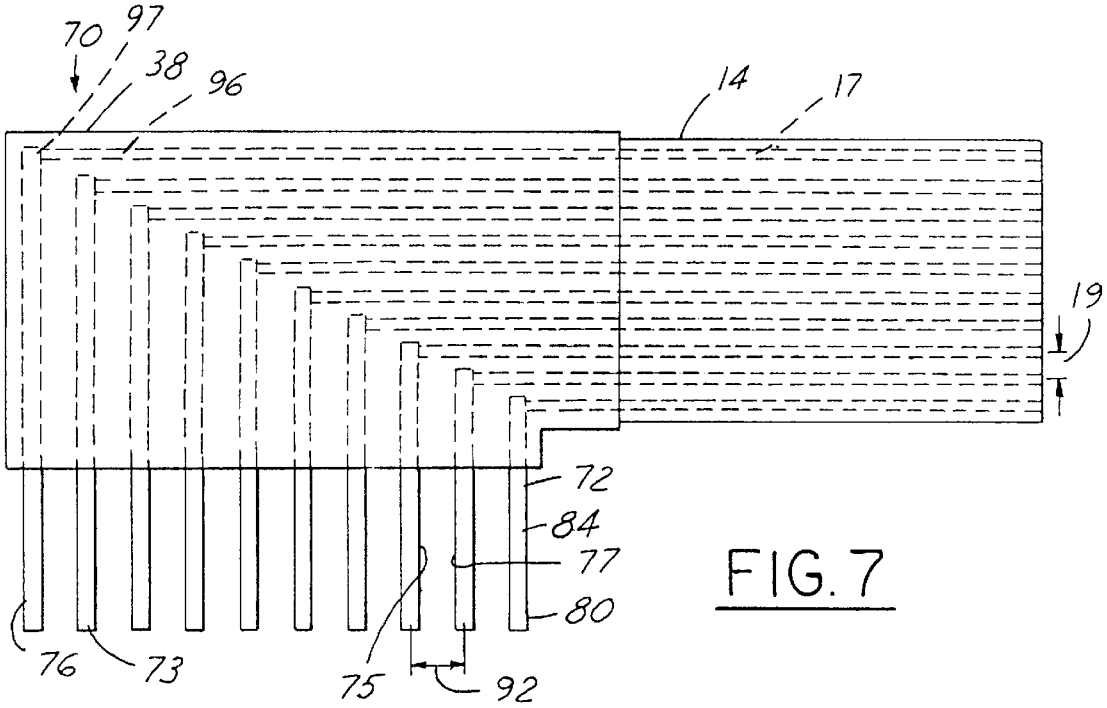
FIG. 7 is a view similar to that of FIG. 6, illustrating separation of the separate terminal pins.

Referring to FIGS. 2, 6 and 7, a radial clock spring enclosure 56 is defined by the hub 10 united with the housing 12 by means of the retaining ring 16. The radial clock spring enclosure 56 contains a coiled clock spring tape 14. In the example shown, the clock spring tape 14 is about 2–4 meters long, having a height of approximately 1.7-cm. The clock spring tape 14 has ten conductive leads 17. The clock spring leads have an approximately 0.85 mm width with a pitch of 1.5 mm. The conductive leads 17 are approximately 0.13 mm thick and insulated on both sides by a 0.1 mm thick sheet of Mylar®. The conductor leads 17 can be foil or powdered metal adhesively held.

Turning to FIG. 1, the clock spring tape 14 has a first end 46 and a second end 48. The first end 46 of the clock spring tape 14 is operatively associated by conductive and physical attachment to a first connector 38 which extends through the housing 12. The second end 48 of the coiled clock spring tape 14 is operatively associated by conductive and physical attachment to a second connector 40 which extends through the hub 10. The connectors 38 and 40 include a terminal with pins held in an insulating plastic over mold.

The single radial bearing 41 is located where the hub 10 is rotatably united with the housing 12 by means of retaining ring 16 (FIG. 3.) The single radial bearing 41 of the clock spring assembly is located at the points where the circular first aperture 24 and aperture lip 26 contact the circular outside dimension 33 of the walled second aperture 37 at first bearing surface 43 and second bearing surface 45.

Referring additionally to FIGS. 6 and 7, an electrical termination arrangement 70 according to the present invention is shown. The termination arrangement 70 includes the aforementioned multiple conductor lead flexible tape 14 which provides the clock spring. The clock spring tape 14 has end 48 (FIG. 1) connected with the hub 10 which is in turn connected with steering wheel or shaft (not shown). The clock spring conductive tape 14 has end 46 (FIG. 1) which is connected with the connector 38 which is fixably attached with the housing 12 which is physically connected with the steering column (not shown). The connectors 38 and 40 (FIG. 1) both have a plurality of terminal pins 73. The first pin is noted as item 72 and the last pin is noted as item 76. To reduce costs, the terminal pins 72 through 76 are stamped from a common sheet of conductive foil material typically, brass, bronze, or copper plated with tin or gold. The pins 73 have a first or bottom end 80 which can be mated with a male or female pin which connects the sensor (or restraint control module) and other electronic devices with the clock spring assembly 5. The first or bottom end 80 of the pins is provided on a pin portion 84. The pin first portions 84 are generally parallel spaced from one another to provide a pitch or pin to pin center distance which is approximately equal to at least 1.5 times the thickness of the sheet metal material and ½ the width of the pin. In other words the lateral adjacent edges 75, 77 of the pins are generally at least 1.5 times the thickness that the material for the pins is stamped from. The pins 73 are 0.1 mm in thickness with a 0.654 width. Accordingly, the pitch or center to center distance 92 between the pins 73 is approximately 1.83 mm. The pitch 92 between the pins 73 will typically be at a ratio of 1.2 or more the pitch of the conductor leads 17 of the clock spring tape 14. The pins from pin 72 to pin 76 serially increase in length. The pins 73 have a second or top end 96. The pins top ends 96 have overlapping contact areas 97 with the conductor leads 17 of the clock spring tape 14. The contact areas 97 between the leads 17 of the clock spring tape 14 and pins 73 serially laterally increase in their position or location from pin 72 to pin 76. The contact areas 97 can be sonic welded. The pins 73 are over molded with an insulating material 79. In FIG. 7 the pins 73 at the bottom ends 80 are severed from a runner or web 83 (FIG. 6) to allow independent electric conductive operation.

The electrical termination arrangement 70 of the present invention is also very useful in other arrangements where electrical interconnection is needed between non-positionally affixed parts, such as powered sliding doors in vans.

Figure 4:
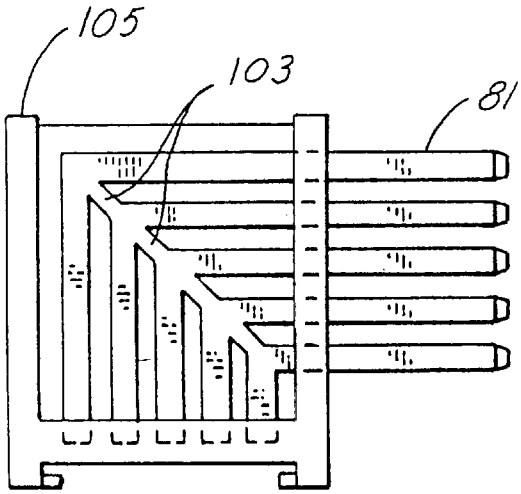
(PRIOR ART) FIG. 4
FIGS. 4 and 5 are front elevational and side views of a prior art electrical terminal arrangement of a clock spring assembly.
Figure 5:
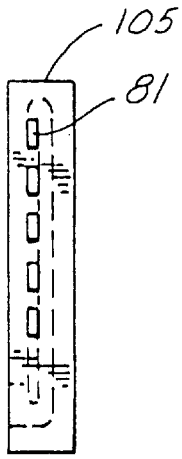
(PRIOR ART) FIG. 5

FIGS. 4 and 5 show a prior art terminal arrangement having pins 81. The pins 81 were stamped with a common webbing 103. The pins 81 were stabilized in a plastic over mold 105. After stabilization, the pin webbings 103 were removed to isolate the pins 81 from one another. The pitch between the pins 81 was generally equal to that of the pitch of the leads on the conductive tape attached to the pins 81. Therefore the pitch of the tape leads was limited in its minimum value to the pitch of the pins 81. The over mold 105 was fixably connected with either the hub or housing member.

The description above has been offered for illustrative purposes only, and is not intended to limit the scope of the invention of this application which is defined in the claims below.

I claim:

1. A clock spring electrical interconnector comprising:

a hub for connection with a first member;

a housing for connection with a second member, said housing rotatively mounting said hub;

a multiple lead conductive flexible tape having first and second ends, said first end of said tape being connected with one of said hub and said housing; and a stamped terminal, said terminal having pins corresponding to said multiple leads of said tape, said pins having first ends for connection with said one of said hub and said housing, said pins being parallel spaced from one another and being serially increasing in length, said pins having contact with said conductive flexible tape in a serially laterally increasing manner, and wherein a ratio of a pitch of said pins to a pitch of said multiple leads of said tape is at least 1.2:1.

2. A clock spring interconnector as described in claim 1 wherein said leads of said flexible tape and pins of said stamped terminal are sonic welded to one another.

3. A clock spring interconnector as described in claim 1 wherein said pins have adjacent lateral edges spaced apart a distance generally at least 1.5 times a thickness of a sheet of material said pins are stamped from.

4. A clock spring interconnector as described in claim 1 wherein said leads in said conductive tape are provided by a powder material adhesively connected with said tape.

5. A clock spring electrical interconnector comprising:

a hub for connection with a first member;

a housing for connection with a second member, said housing rotatively mounting said hub;

a multiple lead conductive flexible tape having first and second ends, said first end of said tape being connected with one of said hub and said housing; and a stamped terminal, said terminal having pins corresponding to said multiple leads of said tape, said pins having first ends for connection with said one of said hub and said housing, said pins having adjacent lateral edges being parallel spaced from one another at least an approximate distance of 1.5 times a thickness of a sheet of material said terminal pins are stamped from, said pins being serially increasing in length, said pins having contact with said leads of said tape in a serially laterally increasing manner, and wherein a ratio of a pitch of said pins to a pitch of said multiple leads of said tape is at least 1.2:1.

* * * * *